US007089975B2

(12) United States Patent
Chrisco et al.

(10) Patent No.: US 7,089,975 B2
(45) Date of Patent: Aug. 15, 2006

(54) SELF-VENTING SPOUT

(75) Inventors: Larry L. Chrisco, Fairland, OK (US); Charlie L. Forbis, Quapaw, OK (US)

(73) Assignee: Blitz U.S.A., Inc., Miami, OK (US)

( * ) Notice: Subject to any disclaimer, the term of this patent is extended or adjusted under 35 U.S.C. 154(b) by 468 days.

(21) Appl. No.: 10/250,077

(22) Filed: Jun. 2, 2003

(65) Prior Publication Data

US 2004/0250879 A1 Dec. 16, 2004

(51) Int. Cl.

| | |
|---|---|
| ***B65B 1/04*** | (2006.01) |
| ***B65B 3/04*** | (2006.01) |
| ***B67C 3/00*** | (2006.01) |

(52) U.S. Cl. ..... 141/286; 141/285; 141/366; 141/363; 141/364; 141/365

(58) Field of Classification Search ..... 141/2, 141/4, 7, 59, 67, 94, 192, 198, 285, 286, 141/290, 291, 301, 302, 351–354, 363–366; 222/566–571, 484, 514, 518, 525

See application file for complete search history.

(56) References Cited

U.S. PATENT DOCUMENTS

| | | | |
|---|---|---|---|
| ,245,401 | A | 8/1881 | Raynor et al. |
| ,365,227 | A | 6/1887 | Beach et al. |
| ,525,744 | A | 9/1894 | Walker |
| ,612,510 | A | 10/1898 | Walker |
| ,748,988 | A | 1/1904 | Schafer |
| ,790,052 | A | 5/1905 | Hardie et al. |
| ,791,261 | A | 5/1905 | Ganon |
| ,886,237 | A | 4/1908 | Murtha |
| 1,327,532 | A | 1/1920 | Duvall |

(Continued)

FOREIGN PATENT DOCUMENTS

| | | |
|---|---|---|
| DE | 218222 | 1/1910 |
| DE | 851610 | 10/1952 |
| DE | 2514278 | 10/1976 |
| GB | 1014483 | 12/1965 |

OTHER PUBLICATIONS

European Patent Publication No. 0 456 612 A3 entitled Liquid Flow Control System Filed Aug. 5, 1991.

PCT International Publication No. WO 92/20590 entitled Pour Spout Filed May 22, 1992.

Declaration of Inventor, Larry L. Chrisco, executed Apr. 6, 2004.

Declaration of inventor, Charlie L. Forbis, executed Apr. 12, 2004.

*Primary Examiner*—Timothy L. Maust
(74) *Attorney, Agent, or Firm*—Hovey Williams LLP

(57) ABSTRACT

A spouted container (10) constructed in accordance with a preferred embodiment of the present invention and configured for storing fluids and transferring the stored fluids to a fluid receiving receptacle such as a lawn mower fluid reservoir (R) is disclosed. The illustrated spouted container (10) broadly includes a storage container (12), a self-venting spout (14) removably coupled to the container (12), a collar (16) for removably coupling the spout (14) to the container (12), and a cap (18) for closing the spout (14) and/or the container (12). The collar (16) cooperates with an inventive sealing disc (32) and a neck (24) to create a gasket-less seal between the spout (14) and the storage container (12) that is adjustable yet prevents undesirable fluid leakage when the spout (14) is in either a pour or a storage position. The spout (14) is a self-venting spout that includes an air-venting passageway (34) formed in part by a flange (60). The inventive flanged configuration of the passageway (34) diverts fluid away from the distal-most end (34*a*) of the passageway (34) thereby enabling fluid to not only smoothly flow, but also to rapidly flow out of the internal chamber (22) under the influence of gravity when the spout (14) is open in the pour position and the storage container (12) is at least partially inverted.

29 Claims, 4 Drawing Sheets

U.S. PATENT DOCUMENTS 1,345,965 A 7/1920 Shute
1,456,854 A 5/1923 McGhee et al.
1,820,197 A 8/1931 McGhee et al.
2,106,453 A 1/1938 Ekdahl
2,154,583 A 4/1939 Rodgers
2,164,314 A 7/1939 Edwards
2,341,950 A 2/1944 Schepps
2,370,668 A 3/1945 Johnson
2,445,130 A 7/1948 Turner
2,471,189 A 5/1949 Bartles
2,593,634 A 4/1952 Vosburg
2,681,759 A 6/1954 Risser
2,701,078 A 2/1955 Bowman
3,005,475 A 11/1961 Beall, Jr.
3,091,373 A 5/1963 Kirschenbaum
3,181,576 A 5/1965 Pellerino et al.
3,204,829 A 9/1965 Song
3,207,190 A 9/1965 Silbereis et al.
3,263,711 A 8/1966 Laub
3,289,712 A 12/1966 Smith
3,540,402 A 11/1970 Kocher
3,595,281 A 7/1971 Laub et al.
3,741,263 A 6/1973 Waxlax
3,863,820 A 2/1975 Wharton
3,934,760 A 1/1976 Le Gresley
3,966,099 A 6/1976 Sanford, Jr. et al.
3,994,323 A 11/1976 Takahata et al.
4,063,667 A 12/1977 Flider
4,069,946 A 1/1978 Flider
4,105,148 A 8/1978 Williams
4,176,694 A 12/1979 Dickerson
4,314,657 A 2/1982 Perakis et al.
4,489,860 A 12/1984 Flider
4,497,422 A 2/1985 Klees
4,555,336 A 11/1985 Nugent et al.
4,568,006 A 2/1986 Mueller et al.
4,588,111 A 5/1986 Hestehave
4,598,743 A 7/1986 Milling
4,667,710 A 5/1987 Wu
4,746,036 A 5/1988 Messner
4,834,151 A 5/1989 Law
4,848,602 A 7/1989 Yoshimura et al.
4,924,921 A 5/1990 Simmel et al.
4,958,668 A 9/1990 Vachon
4,892,881 A 1/1991 Amrein
5,071,037 A 12/1991 Moore et al.
5,074,343 A 12/1991 Tyree, Jr.
5,076,333 A 12/1991 Law
5,107,909 A * 4/1992 Donovan ..... 141/296
5,228,487 A 7/1993 Thiermann et al.
5,234,038 A 8/1993 Mitchell et al.
5,249,611 A 10/1993 Law
5,346,106 A 9/1994 Ring
5,406,994 A 4/1995 Mitchell et al.
5,419,378 A 5/1995 Law
5,447,110 A 9/1995 Brown
5,560,522 A 10/1996 Clark
5,704,408 A 1/1998 Law
5,746,358 A 5/1998 Crosby
5,762,117 A 6/1998 Law
5,765,609 A 6/1998 Dalhart et al.
5,850,949 A 12/1998 Koerbel
5,967,370 A 10/1999 Nettles
5,988,458 A 11/1999 Messner
6,029,858 A 2/2000 Srokose
6,227,419 B1 5/2001 Raboin
6,598,630 B1 * 7/2003 Trippi, Jr. ..... 141/350

* cited by examiner 4
5
16
18
20
22
22a
24
26
30
30b
30c
32
32a
34a
34b
36
36a
38
40
42
44
48
50
52
54
56
58
58a
60
62
62a
64
64a
66
68
70
72

SELF-VENTING SPOUT

BACKGROUND OF INVENTION

1. Field of the Invention

The present invention relates generally to spouts for transferring fluid from a storage container into a fluid receptacle. More specifically, the present invention concerns a spout that removably couples to the container to create a gasket-less seal therebetween that is adjustable yet prevents undesirable fluid leakage. In a preferred embodiment, the spout is a self-venting spout that enables fluid to smoothly and rapidly flow out of the container under the influence of gravity when the spout is open.

2. Discussion of Prior Art

Fluids are often stored in portable containers that enable the fluids to be transported to remotely located fluid receptacles or receiving vessels that must be filled with the fluid. For example, fuel-powered vehicles and machinery such as lawn mowers, chain saws, tractors, and motorized recreational vehicles utilize internal combustion engines that include refillable fuel reservoirs. These fuel-powered machines are often times used at locations that are remote from commercial filling stations such as farms or construction sites. Accordingly, it is desirable to transport the fuel to the remote site in a portable container to enable the fluid reservoir to be quickly and easily refilled without having to transport the machine to the filling station. However, given the nature of the fluids and the sensitivity of the environment in which they are used, it is highly desirable to minimize or eliminate spillage of the fluids during storage, transport and transfer of the fluids.

Spouted storage containers are known in the art. These prior art containers include self-venting spouts that enable smooth and continuous pouring of the fluid from the container. Representative examples of a self-venting spouts are disclosed in U.S. Pat. No. 5,419,378 issued May 30, 1995 and entitled POUR SPOUT, as well as in U.S. Pat. No. 5,762,117 issued Jun. 9, 1998 and entitled VENTED POUR SPOUT AUTOMATICALLY ACCOMMODATING OF TRANSFERRED FLUID VISCOSITY. These prior art self-venting spouts either utilize an air-venting passageway formed inside the fluid conduit or a barricade that obstructs the fluid within the fluid conduit and that includes an aperture that theoretically enables the air to flow backwards over the obstructed fluid. However, these prior art self-venting spouts are problematic and subject to several undesirable limitations. For example, the spouts having the separately formed air-venting passageways provide for a smooth flow, however, in order to prevent fluid from undesirably obstructing the air-venting passageway, they require either a valve at the downstream opening to the air-venting passageway or relatively small capillary sections in the ends of the passageway. The valves are undesirable in that they are part and cost intensive to manufacture and prone to premature failure. The capillary sections are undesirable in that they must be sufficiently small enough to effectively prevent the fluid from obstructing the passageway that they hinder a relatively fast, high volume but smooth pouring of the fluid out of the container.

It is also known in the art to provide a secure seal between a removable spout and the storage container that enables the spout to be stored inside the container when not in use. These prior art spouted storage containers typically utilize one or more gaskets that are compressed between the spout and the container to provide the desired seal. Gaskets provide a desirable adjustable seal, i.e., a seal that remains sealed through a range of motion of the spout relative to the container (e.g., rotating the spout to further threadably tighten the spout relative to the container once the gasket has already achieved a seal therebetween). It is also known to eliminate the need for a gasket by simply compressing a substantially flat surface of the spout against a substantially flat surface of the container. However, these prior art sealing methods are problematic and subject to several limitations. For example, while gaskets provide the desirable adjustable seal, they are separate parts that are relatively expensive to manufacture and are prone to being lost, thereby compromising the seal during use.

The prior art gasket-less seal enables a more cost effective product to be manufactured, however, these gasket-less seals undesirably do not provide an adjustable seal. That is to say, once the flat surfaces are sufficiently compressed together to provide the seal, the spout cannot be further compressed relative to the container without compromising the seal. This is undesirable and problematic because users instinctively threadably tighten the spout as tight against the container as possible by hand. If, however, the flat sealing surfaces have sufficiently engaged prior to the fully tight positioning, portions of both the spout and the container (including the sealing surfaces) can be catastrophically fractured by further tightening of the spout, thus rendering the spout and/or container unsuitable for reuse.

SUMMARY OF INVENTION

The present invention provides an improved spouted container that does not suffer from the problems and limitations of the prior art spouts and containers discussed above. The improved spouted container of the present invention includes a spout that removably couples to the container to create a gasket-less seal therebetween that is adjustable yet prevents undesirable fluid leakage. In a preferred embodiment, the spout is a self-venting spout including an inventive air-venting passageway that is simple and cost effective in construction yet enables fluid to smoothly and rapidly flow at relatively high volumes out of the container under the influence of gravity when the spout is open.

A first aspect of the present invention concerns a self-venting spout for transferring fluid from a container to a receptacle. The spout broadly includes a fluid conduit operable to couple to the container to direct fluid from the container to the receptacle, a venting passageway disposed at least partially within the fluid conduit and being operable to direct air into the container when the fluid conduit is coupled to the container, and a fluid-diverting flange coupled relative to the venting passageway. The fluid conduit presents a first end proximate the container when the fluid conduit is coupled thereto and a second end spaced from and distal to the container when the fluid conduit is coupled thereto. The venting passageway includes a distal-most end spaced from the container when the fluid conduit is coupled to the container. The distal-most end of the venting passageway terminates between the first and second ends of the fluid conduit. The fluid-diverting flange extends at least partially along the passageway. The flange transects the fluid conduit into at least two fluidly isolated fluid chambers adjacent the distal-most end of the venting passageway.

A second aspect of the present invention concerns an apparatus for storing fluid and transferring the stored fluid to a receptacle. The apparatus broadly includes a container presenting an internal chamber operable to store fluid, and a spout assembly removably coupled to the container and including a fluid conduit operable to direct fluid from the container to the receptacle. The container includes a neck defining an opening operable to fluidly communicate the internal chamber with the ambient atmosphere. The neck and opening define a common, center longitudinal neck axis. The fluid conduit presents a first end proximate the neck of the container defining a center longitudinal conduit axis and a second end spaced from and distal to the neck of the container. The neck includes an integrally formed internal circumferential container sealing surface defining,a first obtuse angle relative to the neck axis. The fluid conduit includes an integrally formed first external circumferential conduit sealing surface defining a second obtuse angle relative to the conduit axis and configured to slidably engage the container sealing surface.

A third aspect of the present invention concerns an apparatus for storing fluid and transferring the stored fluid to a receptacle. The apparatus broadly includes a container presenting an internal chamber operable to store fluid, and a spout including a fluid conduit operable to direct fluid from the container to the receptacle and a collar removably coupling the fluid conduit to the container. The container has only a single opening operable to communicate the internal chamber with the ambient atmosphere and includes a neck defining the opening. The opening defines a longitudinal center axis and the neck presents an internal circumferential surface radially spaced from the center axis. The collar removably couples the fluid conduit to the neck of the container. The fluid conduit presents a first end proximate the neck of the container and a second end spaced from and distal to the neck of the container. The collar is detachable from the fluid conduit. The fluid conduit is repositionable when the collar is detached between a pour position wherein the second end is external to the internal chamber and a storage position wherein the second end is disposed within the internal chamber. The fluid conduit includes an integrally formed sealing disc adjacent the first end. The sealing disc presents opposed first and second circumferential sealing surfaces. The first sealing surface shiftably engages the internal circumferential surface of the neck to thereby adjustably seal the conduit and the container when the conduit is in the pour position. The second sealing surface shiftably engages the internal circumferential surface of the neck to thereby adjustably seal the conduit and the container when the conduit is in the storage position. The spout further includes a venting passageway disposed at least partially within the fluid conduit and being operable to direct air into the internal chamber while fluid is directed into the receptacle when the fluid conduit is in the pour position. The venting passageway includes an air intake opening disposed within the fluid conduit and positioned between the first and second ends of the fluid conduit. The spout further includes a fluid-diverting flange coupled relative to the air intake opening and extending at least partially along the passageway to divert fluid away from the air intake opening.

A fourth aspect of the present invention concerns a container for storing fluid and transferring the fluid to a receptacle. The container broadly includes an internal chamber operable to store fluid, a fluid conduit operable to direct fluid from the chamber to the receptacle, a venting passageway disposed at least partially within said fluid conduit and being operable to direct air into the chamber, and a fluid-diverting flange extending at least partially along the passageway. The fluid conduit presents a first end proximate the chamber and a second end spaced from and distal to the chamber. The venting passageway includes a distal-most end spaced from the chamber. The distal-most end of the venting passageway terminates between the first and second ends of the fluid conduit. The flange transects the fluid conduit into at least two fluidly isolated fluid chambers adjacent the distal-most end of the venting passageway.

Other aspects and advantages of the present invention will be apparent from the following detailed description of the preferred embodiments and the accompanying drawing figures.

BRIEF DESCRIPTION OF DRAWINGS

Preferred embodiments of the invention are described in detail below with reference to the attached drawing figures, wherein.

DETAILED DESCRIPTION

Figures 1, 7:
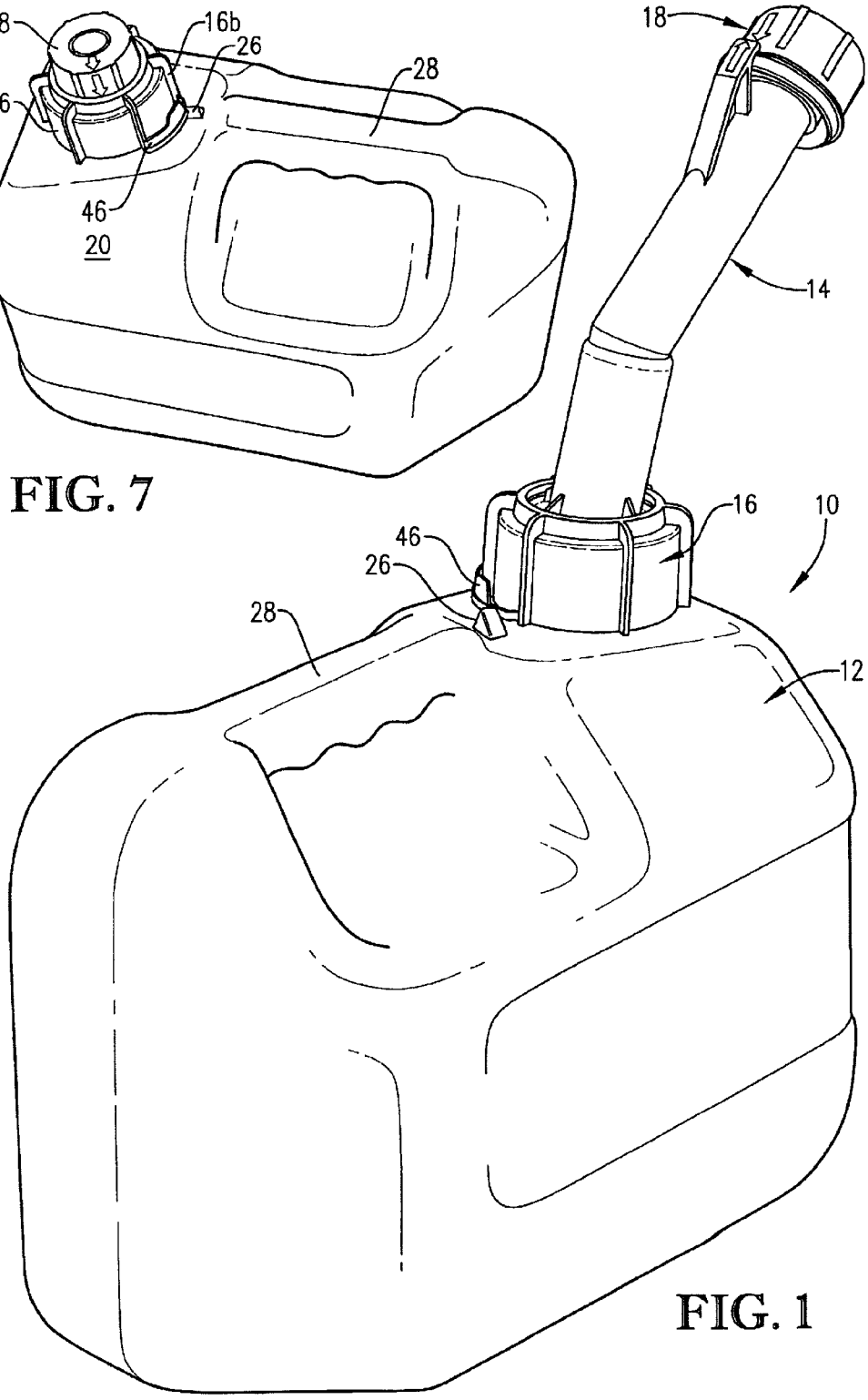
FIG. 1 is a perspective view of a spouted container constructed in accordance with the principles of a preferred embodiment of the present invention and illustrating the collar in the lock position removably coupling the self-venting spout in the pour position to the storage container with the spout being closed by the cap.
FIG. 7 is a perspective view of the spouted container illustrated in FIGS. 1–6 rotated off center showing the cap and collar in the lock position when the spout is in the storage position.
Figures 6, 9:
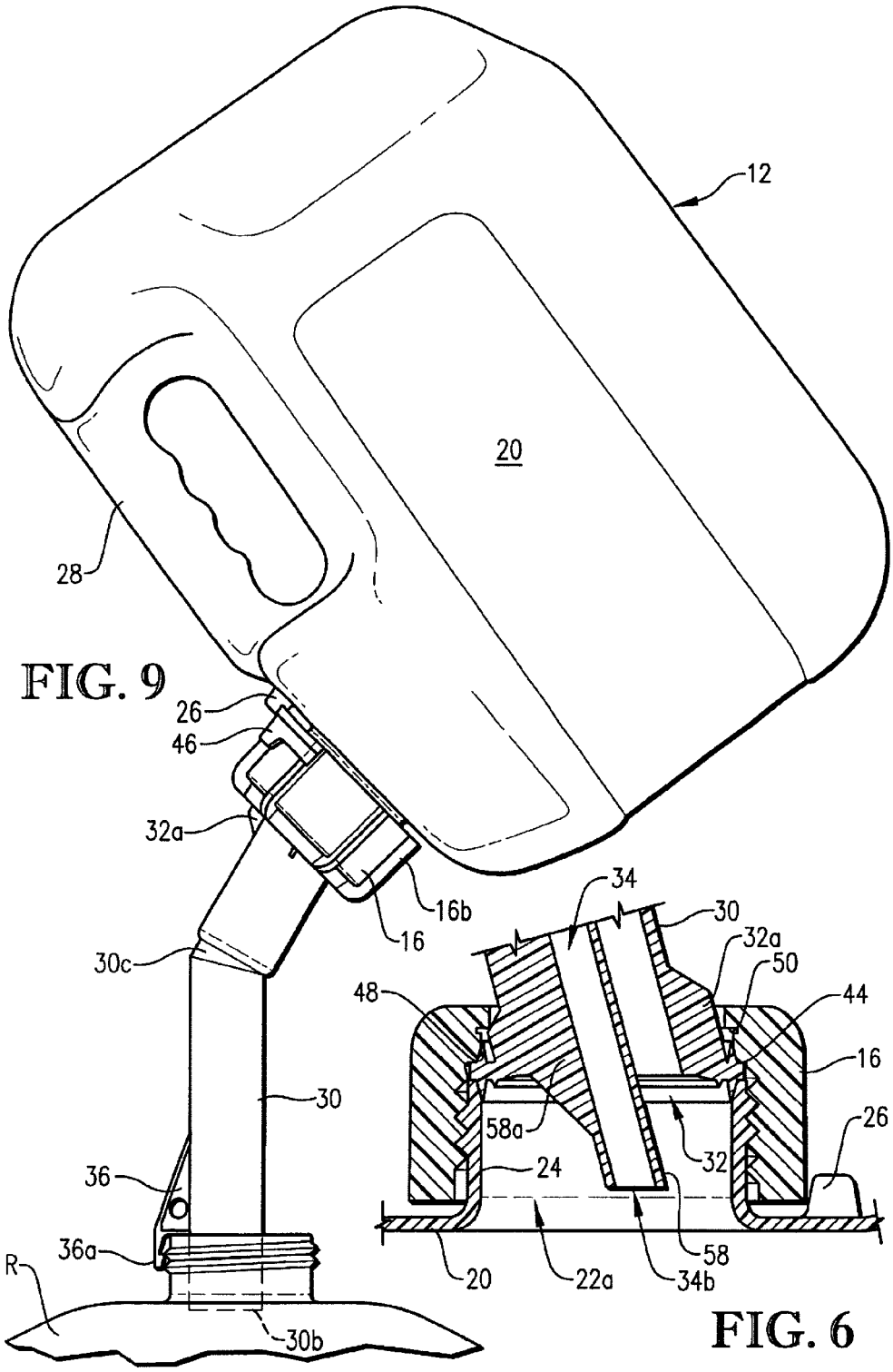
FIG. 6 is a fragmentary longitudinal sectional view of the spouted container illustrated in FIGS. 1–5 with the spout shown in the pour position and the collar shown in the lock position to illustrate the primary and secondary seals as well as the orientation of the lower portion of the air-venting passageway.
FIG. 9 is a side elevational view of the spouted container illustrated in FIGS. 1–8 and shown in the open pour position inverted above a receiving receptacle (shown in fragmentary) for transferring fluids thereto.

FIG. 1 illustrates a spouted container 10 constructed in accordance with a preferred embodiment of the present invention and configured for storing fluids and transferring the stored fluids to a fluid receiving receptacle such as the lawn mower fluid reservoir R shown in FIG. 9. Although the spouted container 10 is particularly well suited for storing and transferring liquid fuels such as gasoline, the principles of the present invention are not limited to spouted containers for storing any particular type of fluid and are equally applicable to containers for storing virtually any type of fluid in a spill-resistant manner. As further detailed below, several aspects of the present invention are directed to the self-venting spout aspects and accordingly apply to spouts configured for use with virtually any type of container, regardless of the existence of, or the type of, seal between the spout and the container. Additionally, as described below, the inventive aspects of the gasket-less seal between the spout and the container equally apply to spouted containers that do not utilize a self-venting spout. The illustrated spouted container 10 broadly includes a storage container 12 and a spout assembly. The spout assembly broadly includes a self-venting spout 14 removably coupled to the container 12, a collar 16 for removably coupling the spout 14 to the container 12, and a cap 18 for closing the spout 14 and/or the container 12.

Figure 2:
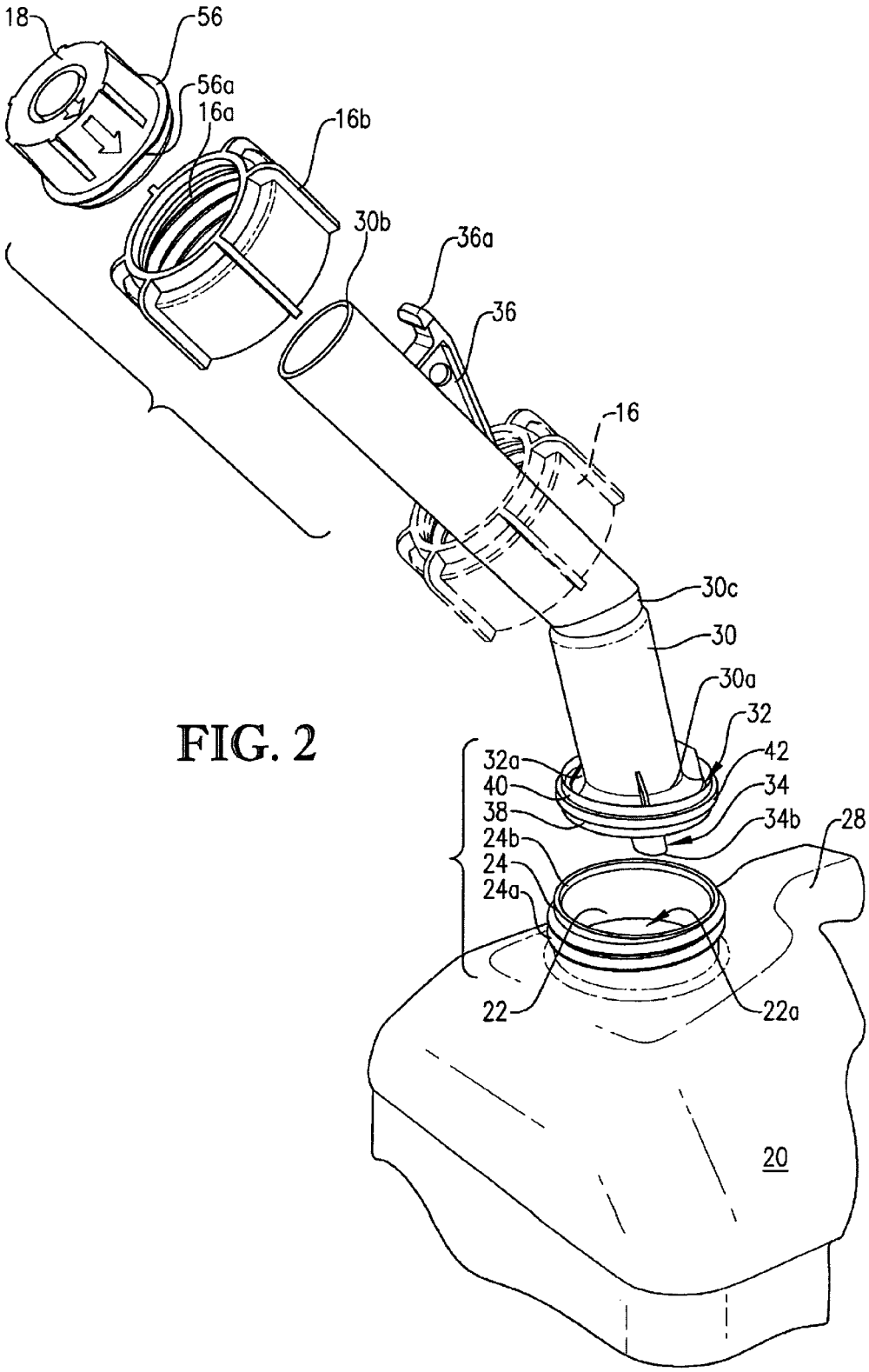
FIG. 2 is an exploded perspective view of the spouted container illustrated in FIG. 1 showing the assembly of the spout, cap and collar (shown removed from the spout in solid and shown sliding over the spout in phantom) into the closed pour position on the container (shown in fragmentary)
Figures 3, 4, 5, 8:
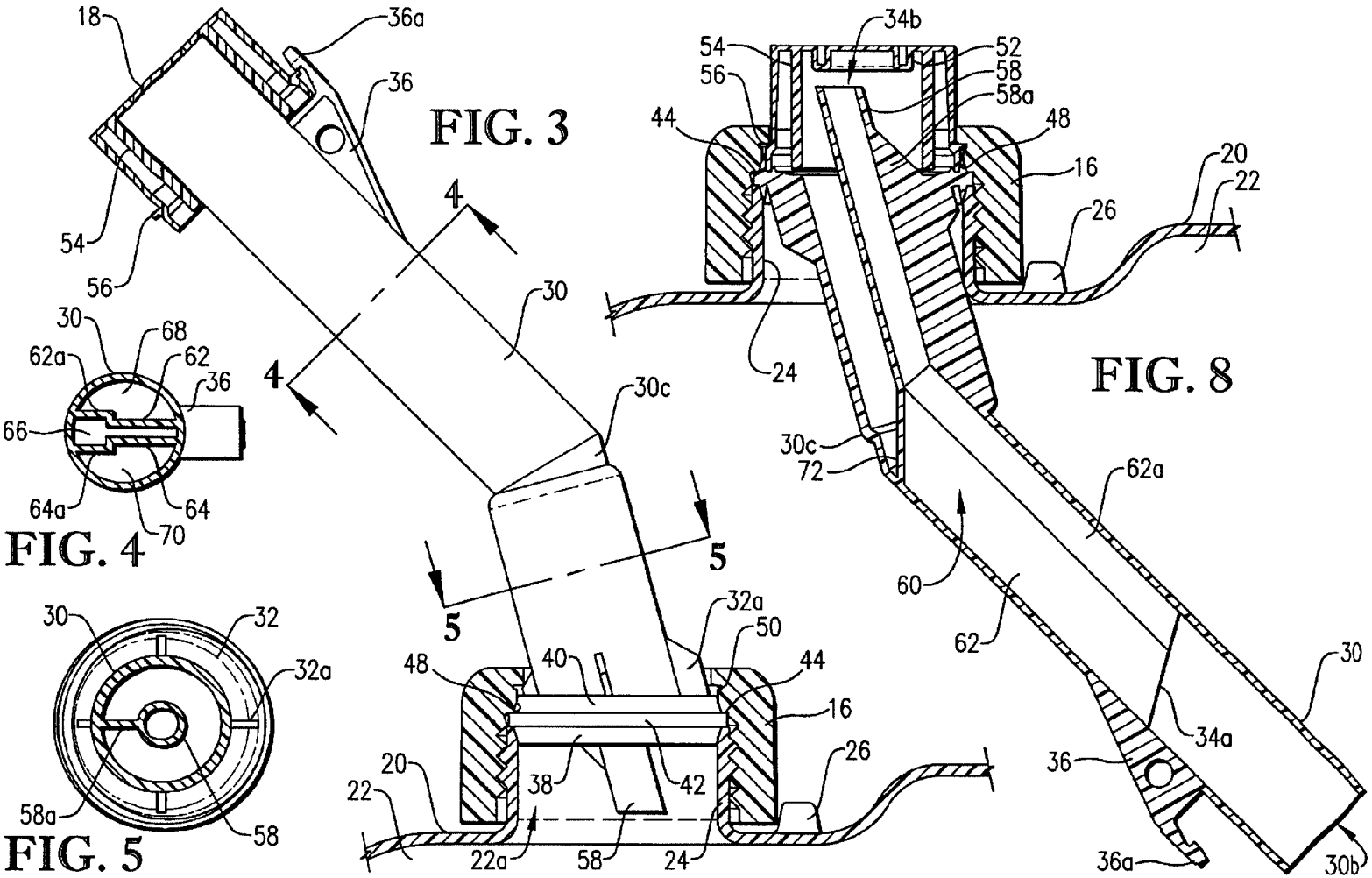
FIG. 3 is a side elevational view of the spouted container illustrated in FIGS. 1 and 2 with the cap (shown in the upper closed position), the collar (shown in the lock position), and the container shown in section illustrating the seal between the lower sealing surface of the spout's disc and the sealing surface of the neck when the spout is in the pour position and the lower sealing surface of the disc is entirely received within the neck.
FIG. 4 is a sectional view of the spouted container taken substantially along line 4—4 of FIG. 3 illustrating the flanged upper portion of the air-venting passageway.
FIG. 5 is a sectional view of the spouted container taken substantially along line 5—5 of FIG. 3 illustrating the lower portion of the air-venting passageway.
FIG. 8 is a longitudinal sectional view of the spouted container illustrated in FIGS. 1–7 with the spout shown in the storage position, the cap shown in the lower closed position, the collar shown in the lock position, and the container shown in fragmentary illustrating the seal between the upper sealing surface of the spout's disc and the sealing surface of the neck when the upper sealing surface of the disc is entirely received within the neck.

Turning to FIGS. 1–3 and 7–9, the container 12 is operable to store fluids therein and is configured to removably receive the spout 14. In more detail, the container 12 includes an exterior wall 20 that defines an internal chamber 22 (see FIGS. 2 and 8). The internal chamber 22 is sized and configured to store fluid (e.g., one, two, five U.S. gallons, etc.). In this regard, the illustrated chamber 22 includes only a single opening 22a located at the top of the chamber 22 but is otherwise fluid-tight. The container 12 further includes a neck 24 that defines the opening 22*a* for fluidly communicating the internal chamber 22 with the ambient atmosphere. In this manner, the neck 24 and the opening 22*a* define a common, center longitudinal container axis. For purposes that will subsequently be described, the neck 24 is configured to removably receive the collar 16. In this regard, the neck 24 includes external threading 24*a*. Additionally, the storage container 12 includes a locking projection 26 (see FIGS. 3 and 8). integrally formed in the wall 20 extending opposite the internal chamber 22 and positioned adjacent the neck 24 for reasons that will be subsequently detailed. As will be further described in detail below, the neck 24 is also configured to cooperate with the spout 14 and the collar 16 to form an adjustable seal between the spout 14 and the container 12 when the spout 14 is secured thereto. In this regard, the illustrated neck 24 includes an integrally formed internal circumferential container sealing surface 24*b*. As shown in FIGS. 2 and 3, the container sealing surface 24*b* is positioned within the neck 24 adjacent the top end thereof. The container sealing surface 24*b* is radially spaced from the center container axis and extends around the entire inside circumference of the neck 24. For purposes that will subsequently be described, the container sealing surface 24*b* defines a first angle relative to the container axis. The illustrated first angle is an acute angle relative to the container axis and is configured so that the sealing surface 24*b* slopes toward the center container axis as it moves away from the top end of the neck 24. The illustrated container 12, including the neck 24, is an integrally formed component formed from a durable, yet fluid-tight material (e.g., molded out of a polymer plastic, resin, etc.). In this manner, the illustrated container 12 also includes an integrally formed handle 28. However, it is within the ambit of the present invention to utilize various alternative configurations for the storage container, for example the container need not be molded plastic and could include features known in the art such as a vent. For purposes that will become apparent, a vent in the container is not preferred when utilizing a self-venting spout (e.g., to provide auto-shutoff capabilities) in connection with the container.

The spouted container 10 is configured to transfer fluid stored in the storage container 12 into fluid receptacles or receiving vessels, such as the fuel reservoir R as shown in FIG. 9. Particularly, the self-venting spout 14 removably couples to the storage container 12 and is configured to direct fluid from the container 12 to the reservoir R when coupled to the container 12. The illustrated spout 14 includes a fluid conduit 30, a sealing disc 32 fixed to the conduit 30, and an air-venting passageway 34 housed in the conduit 30 (see FIG. 2). In more detail, and as shown in FIGS. 2–6 and 9, the fluid conduit 30 is operable to direct fluid from the internal chamber 22 to the fuel reservoir R and thus presents a hollow, generally tubular configuration defining a proximate end 30*a* adjacent the neck 24 and a distal end 30*b* spaced from the neck 24. The illustrated conduit 30 defines a bend 30*c* between the ends 30*a*,30*b* to facilitate transferring fluid there through by positioning the distal end 30*b* of the conduit 30 in the fuel reservoir R while enabling the storage container 12 to be generally centered above the conduit 30 when in a fully inverted orientation as shown in FIG. 9. The illustrated fluid conduit 30 includes a locking lug 36 extending externally from the surface of the conduit 30 and being positioned adjacent the distal end 30*b*. The lug 36 is gusseted to the surface of the conduit 30 to provide sufficient strength and includes a flexible detent latch 36*a* extending from the gusset. The lug 36 facilitates stabilizing the spouted container 10 over the fuel reservoir R when the spouted container 10 is fully inverted during fluid transfers as shown in FIG. 9. Additionally, as detailed below, the lug 36 cooperates with the cap 18 to enable the cap 18 to be locked on, and subsequently unlocked from, the distal end 30*b* of the fluid conduit 30. For reasons that will be detailed below, the fluid conduit 30, including the bend 30*c* and the lug 36, is preferably sized and dimensioned to enable the fluid conduit 30 to fit substantially through the neck 24 and into the internal chamber 22.

The spout 14 is removably coupled to the storage container 12 and is thus repositionable when detached from the storage container 12. The illustrated spout 14 is repositionable between a pour position as shown in FIGS. 1, 3 and 9 wherein the distal end 30*b* of the conduit 30 is external to and spaced from the internal chamber 22 and a storage position as shown in FIGS. 7–8 wherein the distal end 30*b* is disposed within the internal chamber 22. As described in detail below, the collar 16 cooperates with the spout 14 and the storage-container 12 to sealingly secure the spout 14 to the storage container 12 in either of the pour or storage positions. In this regard, the spout 14 is configured to seal against the neck 24 of the storage container 12 in both the pour and the storage positions. Particularly, as shown in FIGS. 2–3, 6 and 8, the inventive sealing disc 32 is configured to cooperate with the neck 24 to create an adjustable seal between the spout 14 and the storage container 12. The illustrated sealing disc 32 includes a lower circumferential sealing surface 38, an upper opposed circumferential sealing surface 40, and a diametrical stopper rib 42 interposed between the upper and lower surfaces 38,40.

In more detail, the illustrated disc 32 is integrally formed with the proximate end 30*a* of the fluid conduit 30 and is reinforced to the conduit 30 by gussets 32*a*. As detailed below, the disc 32 enables the spout 14 to seal against the neck 24 to prevent fluid that is being transferred from the internal chamber 22 through the conduit 30 from leaking out of the designated fluid transfer path through the conduit 30. However, the disc 32 should not impair the flow of fluid from the internal chamber 22 through the conduit 30 when the spout 14 is in the pour position. In this regard, the illustrated disc 32 is open around the proximate end 30*a* of the conduit 30 to allow fluid to freely flow from the internal chamber 22 into the conduit 30. In the illustrated disc 32, the opening is coextensive with the proximate end 30*a* of the conduit 30 so that each define a common, center longitudinal conduit axis that is coextensive with the container axis when the spout 14 is in the pour position. When the spout 14 is in the pour position, the lower circumferential sealing surface 38 cooperates with the container sealing surface 24*b* of the neck 24 to adjustably seal the fluid conduit 30 in fluid communication with the internal chamber 22. Particularly, the lower sealing surface 38 is radially spaced from the center conduit axis and extends endlessly around the outside circumference of the lower end of the disc 32. The lower sealing surface 38 defines a second angle relative to the conduit axis. The illustrated second angle is an acute angle relative to the conduit axis and is configured so that the sealing surface 38 slopes away from the center conduit axis as it moves upwardly away from the lower end of the disc 32 when the spout 14 is in the pour position. The second angle is preferably substantially equal to the first angle described above in connection with the container sealing surface 24*b*. Additionally, the lower conduit sealing surface 38 is preferably sized and dimensioned so that the lower end of the disc 32 sealingly engages the container sealing surface 24*b* yet is enabled to slide along the surface 24*b* and slightly expand the neck 24 while maintaining the sealing engagement between the surfaces 24*b* and 38 until the lower container sealing surface 38 is entirely received within the top end of the neck 24. In this manner, the conduit 30 seals against the neck 24 when the sealing surfaces 24*b*,38 first engage, however, the seal is adjustable in that the seal is maintained as the sealing surface 38 is slid along the sealing surface 24*b* (i.e., as the disc 32 is pressed further into the neck 24). As detailed below, the range of adjustability of the seal between the sealing surfaces 24*b*,38 is limited by the stopper rib 42.

As shown in FIG. 3, the stopper rib 42 of the disc 32 is configured to engage the top end of the neck 24 to limit the extent to which the disc 32 (and thus the proximate end 30*a* of the conduit 30) can be pressed into the neck 24 of the storage container 12. In more detail, the illustrated stopper rib 42 projects radially from the conduit center axis beyond the upper and lower container sealing surfaces 38,40 and extends entirely around the outer circumference of the disc 32. The stopper rib 42 is positioned immediately between the upper and lower container sealing surfaces 38,40 and is configured to present a maximum diameter that is greater than the diameter of the top end of the neck 24 of the storage container 12. In this manner, the stopper rib 42 enables either of the sealing surfaces 38,40 to be pressed into and entirely received within the top end of the neck 24, yet engages the top end of the neck 24 to thereby prevent the rib 42 from being pressed into the top end of the neck 24.

Turning to FIG. 8, the upper conduit sealing surface 40 cooperates with the container sealing surface 24*b*, in a manner similar to that detailed above with respect to the lower sealing surface 38, to provide an adjustable seal between the conduit 30 and the neck 24 when the spout 14 is in the storage position. Particularly, the upper sealing surface 40 is radially spaced from the center conduit axis and extends endlessly around the outside circumference of the upper end of the disc 32 opposite the lower sealing surface 38. The upper sealing surface 40 defines a third angle relative to the conduit axis. The illustrated third angle is an acute angle relative to the conduit axis and is configured so that the sealing surface 40 slopes toward the center conduit axis as it moves upwardly away from the stopper rib 42 of the disc 32 when the spout 14 is in the pour position (see FIG. 3). It will be appreciated that when the spout 14 is in the storage position, the upper conduit sealing surface 40 slopes away from the center conduit axis as it moves upwardly away from the gussets 32*a* of the disc 32 (see FIG. 8). The third angle is preferably substantially equal to the first and second angles described above in connection with the sealing surfaces 24*b*,38. Additionally, similar to the lower conduit sealing surface 38 described above, the upper conduit sealing surface 40 is preferably sized and dimensioned so that the upper end of the disc 32 sealingly engages the container sealing surface 24*b* when the spout 14 is in the storage position, yet is enabled to slide along the surface 24*b* and slightly expand the neck 24 while maintaining the sealing engagement between the surfaces 24*b* and 40 until the upper container sealing surface 40 is entirely received within the top end of the neck 24. In this manner, the conduit 30 seals against the neck 24 when the sealing surfaces 24*b*,40 first engage, however, the seal is adjustable in that the seal is maintained as the sealing surface 40 is slid along the sealing surface 24*b* (i.e., as the disc 32 is pressed further into the neck 24). As detailed above, the range of adjustability of the seal between the sealing surfaces 24*b*,40 is limited by the stopper rib 42. However, unlike when the spout 14 is in the pour position, when the spout 14 is in the storage position, it is immaterial whether the disc 32 impairs the flow of fluid from the internal chamber 22 through the disc 32. In this regard, the upper end of the disc 32 is closed around the conduit 30 to generally prevent fluid from flowing from the internal chamber 22 through the disc 32 when the spout 14 is in the storage position. The disc 32 could be variously configured, however, for purposes that will subsequently be described, it is important that the disc 32 provide an adjustable seal between the spout 14 and the storage container 12 when the spout 14 is in either the pour and/or storage positions.

As indicated above, the spout 14 is removably coupled to the storage container 12 and is repositionable between the pour and storage positions. Particularly, the collar 16 cooperates with the neck 24 to couple the spout 14 to the neck 24 in either the pour and/or storage positions. As shown in FIG. 2, the illustrated collar 16 is configured to slide over the fluid conduit 30 and engage the disc 32 to pull the disc 32 into sealing engagement with the neck 24 as the collar 16 threads onto the neck 24. In more detail, the collar 16 is a ring-shaped collar that is open on both ends, and including internal threading 16*a* along the inside circumferential surface between the open ends complementary to the external threading 24*a* of the neck 24. The open ends are preferably sized and dimensioned to enable the conduit 30, including the lug 36, to freely slide there through as shown in FIG. 2. Additionally, the open lower end of the collar 16 presents a larger diameter than both the stopper rib 42 of the disc 32 and the upper open end of the collar 16. In this regard, a shoulder 44 is defined along the inside circumference of the collar 16 above the internal threading 16*a* and below the upper open end (see FIG. 3). The lower open end of the collar 16 is preferably configured to slide over the entire disc 32 so that the shoulder 44 engages the disc 32 so as to prevent the disc 32 from sliding through the upper open end of the collar 16. In this manner, the lower open end of the collar 16 can be threaded onto to the neck 24 as the shoulder 44 engages the disc 32 to pull the disc 32 into engagement with the neck 24. Particularly, the shoulder 44 is configured to engage the stopper rib 42 of the disc 32 to cause one of the sealing surfaces 38,40 (depending on whether the spout 14 is in the pour or storage position) to press into the top end of the neck 24 as the collar 16 is threaded onto the neck 24 until the respective surface 38,40 is entirely received within the neck 24.

The collar 16 threads onto the neck 24 to secure the spout 14 in one of the pour or storage positions on the storage container 12 in a sealing relationship with the neck 24. Particularly, the illustrated collar 16 includes external grips 16b that facilitate the user rotating the collar 16 by hand. When the spout 14 is oriented toward the pour position on the neck 24, the lower end of the conduit sealing surface 38 initially engages the container sealing surface 24*b* forming a seal there between. As the collar 16 is threaded onto the neck 24, the conduit sealing surface 38 is caused to slide along the container sealing surface 24*b*, maintaining the seal there between. The conduit sealing surface 38 slides along the container sealing surface 24*b* until the surface 38 is entirely received within the neck 24 as shown in FIG. 3 and/or the collar 16 is completely threaded onto the neck 24. Once the conduit sealing surface 38 is entirely received within the neck 24, the stopper rib 42 of the disc 32 engages the top end of the neck 24 to prevent further movement of the spout 14. In this manner, the seal created between the surfaces 38,24*b* is adjustable and maintains the sealing relationship throughout the range of sliding motion of the surface 38 relative to the surface 24*b*. The adjustable nature of this seal provides several advantages over prior art spouted containers, including the gasket-less construction that enables a more cost-effective manufacture with fewer parts. Additionally, the adjustable seal provides the "cork-effect" advantages of a gasket, i.e., it enables users to completely thread the collar 16 onto the neck 24 even after the seal has been established (as users are typically inclined to do) without compromising the seal or catastrophically fracturing the sealing components.

In the illustrated spouted container 10, the disc 32 is configured so that the stopper rib 42 engages the top end of the neck 24 when the collar 16 is completely threaded onto the neck 24. In this regard, the illustrated collar 16 includes a yieldable locking tab 46 configured to engage the projection 26 on the storage container 12 when the collar 16 is completely threaded onto the neck 24 to prevent inadvertent removal of the collar 16 (see FIG. 1). The locking tab 46 ensures the spout 14 will maintain its sealing relationship with the storage container 12 during use and/or storage to thereby prevent undesired inadvertent spillage and/or leakage of fluid from the spouted container 10. Additionally, the locking tab 46, in combination with the cap 18 detailed below, provides a relatively safer storage of potentially dangerous fluids (e.g., gasoline, etc.) in settings that children have access to (e.g., a household garage, etc.) in that it is believed relatively small children would have difficultly in unlocking the tab 46 and thus would be prevented from accessing the fluids stored in the spouted container 10. In order to remove the collar 16 (e.g., for repositioning the spout 14 between the pour and/or storage positions), the user simply depresses the locking tab 46 by hand to clear the projection 26 and rotates the collar 16 in an unthreading direction.

As shown in FIG. 3, the illustrated collar 16 is configured to cooperate with the disc 32 to provide a secondary seal in addition to the seal between the surfaces 38,24*b* when the spout 14 is in the pour position. Particularly, the collar 16 further includes a collar sealing surface 48 extending around the inside circumference of the shoulder 44. In more detail, the collar sealing surface 48 is angled to complement the upper conduit sealing surface 40 when the spout 14 is in the pour position so that the surfaces 48 and 40 sealingly engage one another when the shoulder 44 of the collar 16 engages the stopper rib 42 of the disc 32. In this manner, the surfaces 48,40 provide a secondary seal to ensure no fluid undesirably leaks out of the spouted container 10 when the spout 14 is in the pour position (e.g., should the primary seal prematurely fail, etc.). It will be appreciated that this secondary seal is redundant in that the primary seal between the surfaces 38,24*b* will prevent any fluid from reaching the secondary seal when the spout 14 is in the pour position. For purposes that will subsequently be described, the collar 16 further includes a cap-retaining lip 50 formed along the inside surface and positioned between the sealing surface 48 and the open upper end of the collar 16 (see FIGS. 3 and 6).

Turning to FIG. 8, in a manner similar to the formation of the primary and secondary seals detailed above with respect to the spout 14 being in the pour position, the collar 16 cooperates with the disc 32 and the neck 24 to provide an adjustable seal and a secondary seal when the spout 14 is in the storage position. Particularly, when the spout 14 is in the storage position as shown in FIG. 8 and the collar 16 is threaded onto the neck 24, the upper conduit sealing surface 40 sealingly engages the container sealing surface 24*b*. This seal is also an adjustable seal, i.e., the seal is maintained while the collar 16 threads further onto the neck 24 pressing the surface 40 entirely into the neck 24 until the stopper rib 42 engages the top end of the neck 24. When the spout 14 is in the storage position and the collar 16 is completely threaded onto the neck 24, the lower conduit sealing surface 38 cooperates with the collar sealing surface 48 to provide a secondary, redundant seal. However, unlike when the spout 14 is in the pour position, when the spout 14 is in the storage position, fluid cannot freely flow past the disc 32 and through the collar 16 because, as detailed below, the cap 18 cooperates with the collar 16 to completely seal off the internal chamber 22 from the ambient atmosphere.

As shown in FIGS. 1–3 and 7–8, the illustrated cap 18 is configured to removably couple to both the fluid conduit 30 and to the collar 16 to completely prevent fluid stored within the spouted container 10 from exiting the container 10 when the spout 14 is in the pour position and/or the storage position, respectively. Turning initially to FIGS. 7–8, when the spout 14 is in the storage position, the cap 18 can be coupled to the collar 16 prior to threading the collar 16 onto the neck 24 so that when the collar 16, laden with the cap 18, is threaded onto the neck 24, the internal chamber 22 is completely sealed off, in a child proof manner, so that fluid cannot inadvertently or accidently spill or leak out of the spouted container 10. In more detail, the illustrated cap 18 includes a cylindrically shaped outer wall presenting a closed upper end and an open lower end. For purposes that will subsequently be described, the cap 18 includes a sealing ring 52 formed in the inside surface of the closed upper end that is configured to fit snugly within the distal end 30*b* of the conduit 30. The cap 18 further includes a sealing cylinder 54 formed inside the cap 18 and positioned outside of the ring 52 and concentrically inside the outer wall of the cap 18 (see FIG. 8). The cylinder 54 is configured to fit snugly over the distal end 30*b* of the conduit 30. The cap 18 further includes a locking ring 56 radially extending around the outside circumference of the outer wall and positioned adjacent the open lower end of the cap 18. For purposes that will subsequently be described, the locking ring 56 includes a recessed detent section 56*a* (located below the arrow on the cap 18 in FIG. 2).

The locking ring 56 is configured to cooperate with the cap-receiving lip 50 of the collar 16 to retain the cap 18 coupled to the collar 16. Particularly, when the collar 16 is removed from the conduit 30, the cap 18 can be pressed through the lower end of the collar 16 until the locking ring 56 slides over the collar sealing surface 48 and "snaps" into position between the surface 48 and the cap-receiving lip 50 (see FIG. 8). To remove the cap 18 from the collar 16, the user simply applies sufficient pressure on the upper closed end of the cap 18 to snap the locking ring 56 out of the lip 50. As shown in FIG. 8, the cylinder 54 is sized and dimensioned so that when the spout 14 is in the storage position, there is sufficient clearance for the collar 16, laden with the cap 18, to be completely threaded onto to the neck 24 without interfering with the fluid conduit 30 or the air-venting passageway 34. It will be appreciated, that when the collar 16 and cap 18 are secured over the neck 24, the cap 18 cannot be removed without first removing the collar 16 from the neck 24. As described above, the collar 16 cannot be removed from the neck 24 without first depressing the locking tab 46 on the collar 16 so that it clears the projection 26 on the storage container 12. In this manner, the spouted container 10 is child proof when in the spout 14 is in the storage position and the collar 16, laden with the cap 18, is completely threaded onto the neck 24.

Turning now to FIGS. 1–3, the cap 18 is also configured to removably couple to the fluid conduit 30 to completely prevent fluid stored within the spouted container 10 from exiting the fluid conduit 30 (and thus the internal chamber 22) when the spout 14 is in the pour position. Particularly, the cap 18 is simply pressed onto the distal end 30*b* of the fluid conduit 30 when the spout 14 is in the pour position until the locking ring 56 is received under the detent latch 36*a* of the locking lug 36 on the conduit 30. In this position, the distal end 30*b* of the conduit 30 is pressed into the cap 18 so that the distal end 30*b* of the conduit 30 is received between, and sealing engages, the sealing ring 52 and the sealing cylinder 54 and thus fluid stored within the spouted container 10 is completely prevented from exiting the conduit 30. The cap 18 is also child proof in this position (and thus for safety, cannot be removed inadvertently or by a small child) in that once the locking ring 56 is received within the detent latch 36*a*, the cap 18 must be rotated until the recessed detent portion 56*a* aligns with the detent latch 36*a* in order to remove the cap 18. As shown in FIG. 1, the illustrated cap 18 and locking lug 36 include arrows that align to indicate when the detent portion 56*a* and detent latch 36*a* align. In this regard, the cap 18 enables the spouted container 10 to be safely stored even with the spout 14 in the pour position without the risk of potentially dangerous fluids being inadvertently or accidently spilled out of the container 10. Although the child safety features provided by the cap 18 are preferred, for purposes of the present invention, the cap 18 could be variously configured and it is not necessary that the spouted container 10 even include a cap.

It is within the ambit of the present invention to utilize various alternative configurations for sealing the spout 14 to the storage container 12, for example, as indicated above, the spouted container need not utilize a cap and need not provide secondary seals. However, it is important that the seal configuration enable a gasket-less seal that is also adjustable as defined above. As detailed below, the illustrated spout 14 is a self-venting spout, however, the adjustable gasket-less seal need not be utilized with a self-venting spout, but equally applies to sealing virtually any type of spout to a container.

As previously indicated, the illustrated spout 14 is a self-venting spout. In this regard, the spout 14 includes the air-venting passageway 34 housed within the fluid conduit 30. The passageway 34 is configured to direct air into the storage container 12 when the fluid conduit 30 is coupled to the storage container 12 in the pour position and the spout 14 is open (i.e., the cap 18 is removed from the distal end 30*b* of the conduit 30). Additionally, the air venting passageway 34 is configured to enable fluid to smoothly and rapidly flow out of the conduit 30 under the influence of gravity when the spout 14 is open. Turning to FIGS. 3–6 and 8, the illustrated air-venting passageway 34 presents a distal-most end 34*a* spaced from the storage container 12 when the spout 14 is in the pour position and an oppositely spaced proximate end 34*b* received within the neck 24 when the spout 14 is in the pour position. The air-venting passageway 34 is at least partially disposed within the fluid conduit 30 so that the distal-most end 34*a* terminates within the fluid conduit 30 (i.e., terminates somewhere between the proximate and distal ends 30*a*,30*b* of the conduit 30 as shown in FIG. 8). The illustrated passageway 34 includes, and is defined by, a vent tube 58 and a fluid-diverting flange 60 in communication with the vent tube 58. In more detail, the vent tube 58 is generally cylindrical in shape and defines the proximate end 34*b* of the passageway 34 and extends therefrom through the disc 32 and the proximate end 30*a* of the conduit 30 up to the bend 30*c* of the conduit 30. As shown in FIG. 5, the vent tube 58 is radially spaced from the inside surface of the fluid conduit 30 and is in a generally concentric relationship with the conduit 30. In this regard, the vent tube 58 is secured to the fluid conduit 30 by a gusset 58*a* to retain the tube 58 in the spaced, concentric relationship. In this manner, when the storage container 12 is oriented to cause fluid to flow out of the internal chamber 22 into and through the conduit 30 (see FIG. 9), the fluid conduit 30 has sufficient space around the tube 58 to enable the fluid to flow around the vent tube 58 and into the conduit 30. That is to say, the path of least resistance for the fluid is not through the vent tube 58 but rather along the neck 24 and into the proximate end 30*a* of the conduit 30.

The illustrated fluid-diverting flange 60 is coupled to, and in communication with, the vent tube 58 and thereby forms a portion of the passageway 34 including the distal-most end 34*a* of the air-venting passageway 34. The flange 60 is configured to divert fluid away from the distal-most end 34*a* of the passageway 34 to enable a sufficient and continuous flow of air through the passageway 34 during pouring. In more detail, as shown in FIGS. 4 and 8, the flange 60 includes, and is defined by, a pair of spaced apart walls 62 and 64. The walls 62 and 64 extend chordally across the interior of the fluid conduit 30. In this regard, the walls 62,64 transect the conduit 30 into three defined chambers extending the length of the flange 60 including an interior air chamber 66 defined between the walls 62,64, and a pair of fluid chambers 68 and 70 defined outside the corresponding wall 62 and 64, respectively. Each of the walls 62,64 extends entirely across the interior of the fluid conduit 30 and is sealed therewith so that the interior air chamber 66 is fluidly isolated along the flange 60 from each of the fluid chambers 68,70. The interior air chamber 66 is in communication with the vent tube 58 so that air entering the distal-most end 34*a* of the passageway 34 flows through the air chamber 66, through the vent tube 58 and into the internal chamber 22 when the spout 14 is in the pour position. In this regard, the flange 60 includes a back wall 72 that seals between the walls 62,64, the fluid conduit 30, and the vent tube 58 so that all air flowing through the air chamber 66 must flow into the vent tube 58 (see FIG. 8). Additionally, the back wall 72 functions to divide, and thus direct, fluid flowing through the conduit 30 into the two fluid chambers 68,70. The illustrated walls 62,64 are each configured to cooperate with one another to define a generally inverted T-shaped cross-sectional shape for the interior air chamber 66. Particularly, each wall 62,64 includes a corresponding jut-out section 62*a* and 64*a*, respectively. The jut-out sections 62*a*,64*a* are opposed so as to define a larger cross-sectional area at the bottom of the inverted T-shape than at the top thereof (see FIG. 4). In this manner, the interior chamber 66 is sufficiently large to handle enough air flowing there through to enable a relatively high volume of fluid to smoothly and quickly flow through the conduit 30. Furthermore, it is believed that the inverted T-shape facilitates the prevention of fluid from completely blocking the air chamber 66 even during high volume pouring. In this regard, the flange walls 62,64 preferably each extend angularly relative to the interior of the fluid conduit 30 at the distal-most end 34*a* of the passageway 34 so that the relatively thinner top of the inverted T-shape extends out over the relatively larger jut-out bottom of the inverted T-shape (see FIG. 8). It is believed that during relatively high-volume pouring conditions (i.e., where the fluid conduit 30 is prevalently filled with fluid), this preferable configuration enables the flange 60 to reliably ensure that at least a portion of the distal-most end 34*a* of the air-venting passageway 34 is operable to intake air. That is to say, fluid will naturally fall off of the jut-out sections 62*a*,64*a* toward the lower interior surface of the fluid conduit 30 at the distal-most end 34*a* of the passageway 34 thereby leaving at least the top portion of the interior air chamber 66 open to receive air back flowing over the fluid.

It will be appreciated that the air-venting passageway 34 provides the spout 14 with desirable self-venting features such as smooth fluid flow from the internal chamber 22 through the conduit 30 and automatic shutoff once the distal end 30*b* of the conduit 30 is closed by fluid in the fluid reservoir R. However, unlike prior art self-venting spouts, the inventive flanged configuration of the passageway 34 diverts fluid away from the distal-most end 34*a* of the passageway 34 thereby enabling fluid to not only smoothly flow, but also to rapidly flow out of the internal chamber 22 under the influence of gravity when the spout 14 is open in the pour position and the storage container 12 is at least partially inverted. Additionally, the unique flanged configuration of the passageway 34 enables a relatively larger air entry (e.g., the distal-most end 34*a*) into the passageway 34 which enables the more rapid pouring of fluid and enables the distal-most end 34*a* to be located inside the fluid conduit 30. This inside positioning is desirable in that it enables the entire spout 14 to be cost-effectively molded during manufacture (e.g., in a single mold without the need for additional, costly post-molding processing). However, it is within the ambit of the present invention to utilize various alternative configurations for the air-venting passageway, although the passageway preferably includes means to divert fluid away from the distal-most end of the passageway so that the distal-most end can be configured for relatively large amounts of air entry and positioned within the fluid conduit. For example, although less preferred, the fluid-diverting means need not be located at the distal-most end of the passageway so long as fluid is sufficiently diverted to enable air to be drawn into the distal-most end, such as positioning the fluid-diverting means adjacent the end and configuring it to cause sufficient turbulence in the fluid to enable air to be drawn into the distal-most end. Additionally, as previously indicated, the self-venting features of the spout 14 detailed above are not limited to any particular type of container and accordingly apply to spouts configured for use with virtually any type of container, regardless of the existence of, or the type of, seal between the spout and the container. For example, the spout and the container could be integrally formed.

In operation, the spouted container 10 can be utilized to safely and securely store fluids as well as rapidly transfer the stored fluids to a receiving vessel without the fluids undesirably spilling and/or leaking during the transfer. Particularly, to transfer fluids stored in the storage container 12 (e.g., from the closed, storage position shown in FIG. 7), the collar 16, laden with the cap 18, is first removed from the neck 24 by depressing the locking tab 46 until it clears the projection 26 and unthreading the collar 16 from the neck 24 (e.g., rotating the collar 16 in a counter clockwise direction when viewed as in FIG. 7). The cap 18 is next removed from the collar 16 by pressing the cap 18 through the collar 16 until the locking ring 56 slides out from between the collar sealing surface 48 and the cap-receiving lip 50. The spout 14 is then removed from the internal chamber 22.

The spout 14 can then be placed in the pour position by aligning the disc 32 in the neck 24 and then sliding the collar 16 over the spout 14 and threading the collar 16 onto the neck 24 (see FIG. 2). The collar 16 is threaded onto the neck 24 until the locking tab 46 catches behind the projection 26, and thus the lower conduit sealing surface 38 is fully received within the container sealing surface 24*b*. The spout 14 is now open and in the pour position. To transfer fluids stored in the internal chamber 22, the distal end 30*b* of the conduit 30 is placed in a receiving vessel, such as the fuel reservoir R, so that the detent latch 36*a* of the locking lug 36 engages the opening to the reservoir R as shown in FIG. 9. With the storage container 12 inverted as shown in FIG. 9, fluids from the internal chamber 22 smoothly and rapidly flow through the fluid conduit 30 into the reservoir R while air back flows from the reservoir R (or atmosphere) through the passageway 34 and into the internal chamber 22. This fluid-air exchange causes the fluid to smoothly and rapidly flow until the reservoir R is full and thus the distal end 30*b* of the fluid conduit 30 is closed by the fluid in the reservoir R thereby causing the back flow of air to cease. Once the back flow of air through the passageway 34 ceases, a vacuum is created within the internal chamber 22 which prevents the flow of fluid through the conduit 30.

In order to return the spouted container 12 to a safe and secure storage orientation, the spout 14 can be left in the pour position and the cap 18 can be placed over the distal end 30*b* of the conduit 30 until the locking ring 56 engages the detent latch 36*a* of the locking lug 36. In order to remove the cap 18 from this position, the detent section 56*a* of the locking ring 56 must be aligned with the detent latch 36*a* to enable the cap 18 to be slid off of the fluid conduit 30. Alternatively, the spouted container 10 can be returned to the position as shown in FIG. 7, by reversing the steps previously described to return the spout 14 to the storage position, then snapping the cap 18 into the collar 16, and threading the collar 16 onto the neck 24 until the locking tab 46 engages the projection 26.

The preferred forms of the invention described above are to be used as illustration only, and should not be utilized in a limiting sense in interpreting the scope of the present invention. Obvious modifications to the exemplary embodiments, as hereinabove set, forth, could be readily made by those skilled in the art without departing from the spirit of the present invention The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A self-venting spout for transferring fluid from a container to a receptacle, said spout comprising:

a fluid conduit operable to couple to the container to direct fluid from the container to the receptacle, said fluid conduit presenting a first end proximate the container when the fluid conduit is coupled thereto and a second end spaced from and distal to the container when the fluid conduit is coupled thereto;

a venting passageway disposed at least partially within said fluid conduit and being operable to direct air into the container when the fluid conduit is coupled to the container, said venting passageway including a distal-most end spaced from the container when the fluid conduit is coupled to the container, said distal-most end of the venting passageway terminating between said first and second ends of the fluid conduit; and a fluid-diverting flange extending at least partially along the passageway, said flange transecting said fluid conduit into at least two fluidly isolated fluid chambers adjacent said distal-most end of the venting passageway.

2. The spout as claimed in claim 1, said fluid conduit presenting a generally tubular configuration.

3. The spout as claimed in claim 2, said fluid conduit defining a bend between the first and second ends thereof.

4. The spout as claimed in claim 3, said venting passageway including a proximate-most end opposite the distal-most end, said venting passageway including a first section defined between the proximate-most end and the bend in the fluid conduit and a second section defined between the first section and the distal-most end.

5. The spout as claimed in claim 4, said flange including a pair of spaced apart walls extending chordally across the fluid conduit and defining an interior air chamber between the walls and defining said fluid chambers outside the walls, said interior air chamber being fluidly isolated from each of said fluid chambers.

6. The spout as claimed in claim 5, said interior air chamber comprising the second section of said venting passageway.

7. The spout as claimed in claim 6, said first section of said venting passageway being defined by a vent tube defining a generally cylindrical shape.

8. The spout as claimed in claim 7, said vent tube being in a generally concentric relationship with said fluid conduit.

9. The spout as claimed in claim 8, said vent tube being radially spaced from said fluid conduit.

10. The spout as claimed in claim 9, said interior air chamber defining a generally inverted T-shaped cross-sectional shape between the flange walls and the inner circumferential surface of the fluid conduit so as to define a larger cross-sectional area at the bottom of the inverted T-shape than at the top thereof.

11. The spout as claimed in claim 10, said flange walls extending angularly relative to the fluid conduit at the distal-most end of the venting passageway so that the top of the inverted T-shape extends out over the bottom of the inverted T-shape.

12. An apparatus for storing fluid and transferring the stored fluid to a receptacle, said apparatus comprising:

a container presenting an internal chamber operable to store fluid, said container having only a single opening operable to communicate the internal chamber with the ambient atmosphere and including a neck defining said opening, said opening defining a longitudinal center axis and said neck presenting an internal circumferential surface radially spaced from said center axis; and a spout including a fluid conduit operable to direct fluid from the container to the receptacle and a collar removably coupling the fluid conduit to the neck of the container, said fluid conduit presenting a first end proximate the neck of the container and a second end spaced from and distal to the neck of the container, said collar being detachable from said fluid conduit, said fluid conduit being repositionable when said collar is detached between a pour position wherein said second end is external to the internal chamber and a storage position wherein the second end is disposed within the internal chamber, said fluid conduit including an integrally formed sealing disc adjacent the first end, said sealing disc presenting opposed first and second circumferential sealing surfaces, said first sealing surface shiftably engaging the internal circumferential surface of the neck to thereby adjustably seal the conduit and the container when the conduit is in the pour position, said second sealing surface shiftably engaging the internal circumferential surface of the neck to thereby adjustably seal the conduit and the container when the conduit is in the storage position, said spout further including a venting passageway disposed at least partially within said fluid conduit and being operable to direct air into the internal chamber while fluid is directed into the receptacle when the fluid conduit is in the pour position, said venting passageway including an air intake opening disposed within the fluid conduit and positioned between said first and second ends of the fluid conduit, said spout further including a fluid-diverting flange coupled relative to the air intake opening and extending at least partially along the passageway to divert fluid away from the air intake opening.

13. The apparatus as claimed in claim 12, and a cap removably couplable to the second end of the fluid conduit when the fluid conduit is in the pour position, said cap being operable to prevent fluid from exiting the fluid conduit when the cap is coupled to the fluid conduit.

14. The apparatus as claimed in claim 13, said cap removably couplable to the collar when the fluid conduit is in the storage position, said cap being operable to prevent fluid from exiting the container when the cap is coupled to the collar.

15. The apparatus as claimed in claim 12, said flange transecting said fluid conduit into at least two fluidly isolated fluid chambers at said air intake opening of the venting passageway.

16. The apparatus as claimed in claim 15, said air intake opening defining a first end of the venting passageway, said passageway presenting an opposite second end and defining a bend between the first and second ends thereof, said venting passageway including a first section defined between the first end and the bend in the fluid conduit and a second section defined between the first section and the second end.

17. The apparatus as claimed in claim 16, said flange including a pair of spaced apart walls extending chordally across the fluid conduit and defining an interior air chamber between the walls and defining said fluid chambers outside the walls, said interior air chamber being fluidly isolated from each of said fluid chambers, said interior air chamber comprising the first section of said venting passageway.

18. The apparatus as claimed in claim 17, said second section of said venting passageway being defined by a vent tube defining a generally cylindrical shape and being radially spaced from said fluid conduit.

19. The apparatus as claimed in claim 12, said collar being threadably received on said neck and rotatable into and out of first and second sealing positions when the fluid conduit is in the pour position, said first sealing surface being partially received within said neck when the collar is in the first sealing position and said first sealing surface being entirely received within said neck when the collar is in the second sealing position.

20. The apparatus as claimed in claim 19, said collar being rotatable into and out of third and fourth sealing positions when the fluid conduit is in the storage position, said second sealing surface being partially received within said neck when the collar is in the third sealing position and said second sealing surface being entirely received within said neck when the collar is in the fourth sealing position.

21. The apparatus as claimed in claim 20, said disc further including a diametrically extending stopper rib positioned between the opposed first and second sealing surfaces, said stopper rib engaging the top end of the neck when the fluid conduit is in the pour and storage positions and being configured to prevent rotation of the collar past the second sealing position when the fluid conduit is in the pour position and to prevent rotation of the collar past the fourth sealing position when the fluid conduit is in the storage position.

22. A container for storing fluid and transferring the fluid to a receptacle, said container comprising:

an internal chamber operable to store fluid; a fluid conduit operable to direct fluid from the chamber to the receptacle, said fluid conduit presenting a first end proximate the chamber and a second end spaced from and distal to the chamber;

a venting passageway disposed at least partially within said fluid conduit and being operable to direct air into the chamber, said venting passageway including a distal-most end spaced from the chamber, said distal-most end of the venting passageway terminating between said first and second ends of the fluid conduit; and a fluid-diverting flange extending at least partially along the passageway, said flange transecting said fluid conduit into at least two fluidly isolated fluid chambers adjacent said distal-most end of the venting passageway.

23. The container as claimed in claim 22, said fluid-diverting flange extending from the distal-most end of said passageway.

24. The container as claimed in claim 22, said flange including a pair of spaced apart walls extending chordally across the fluid conduit and defining an interior air chamber between the walls and defining said fluid chambers outside the walls, said interior air chamber being fluidly isolated from each of said fluid chambers.

25. The container as claimed in claim 24, said interior air chamber defining a generally inverted T-shaped cross-sectional shape between the flange walls and the inner circumferential surface of the fluid conduit so as to define a larger cross-sectional area at the bottom of the inverted T-shape than at the top thereof.

26. The container as claimed in claim 25, said flange walls extending angularly relative to the fluid conduit at the distal-most end of the venting passageway so that the top of the inverted T-shape extends out over the bottom of the inverted T-shape.

27. The container as claimed in claim 22, said venting passageway being defined at least in part by a vent tube defined a generally cylindrical shape.

28. The container as claimed in claim 27, said venting tube being in a generally concentric relationship with said fluid conduit.

29. The container as claimed in claim 28, said vent tube being radially spaced from said fluid conduit.

* * * * *

UNITED STATES PATENT AND TRADEMARK OFFICE

CERTIFICATE OF CORRECTION

PATENT NO. : 7,089,975 B2
APPLICATION NO. : 10/250077
DATED : August 15, 2006
INVENTOR(S) : Chrisco et al.

It is certified that error appears in the above-identified patent and that said Letters Patent is hereby corrected as shown below:

Title page,
Item (75), Inventors, should read:

-- Larry L. Chrisco, Fairland, OK (US);
Charlie L. Forbis, Quapaw, OK (US);
Roger Nielsen, Meridian, ID (US) --

Signed and Sealed this

Sixteenth Day of January, 2007

JON W. DUDAS
*Director of the United States Patent and Trademark Office*